United States Patent [19]

Tratz et al.

[11] 4,060,124

[45] Nov. 29, 1977

[54] FEEDWATER PREHEATER WITH TWO STEAM CHAMBERS

[75] Inventors: Herbert Tratz, Ottensoos; Fritz Kelp; Erich Netsch, both of Erlangen, all of Germany

[73] Assignee: Kraftwerk Union Aktiengesellschaft, Mulheim (Ruhr), Germany

[21] Appl. No.: 638,456

[22] Filed: Dec. 8, 1975

[30] Foreign Application Priority Data

Dec. 10, 1974 Germany ..... 2458471

[51] Int. Cl.[2] ..... F22D 1/32

[52] U.S. Cl. ..... 165/110; 122/32; 165/158

[58] Field of Search ..... 122/32; 165/110, 158

[56] References Cited

U.S. PATENT DOCUMENTS

| | | | |
|---|---|---|---|
| 2,061,980 | 11/1936 | Price | 165/158 |
| 2,306,895 | 12/1942 | Nelson | 165/110 |
| 3,101,595 | 8/1963 | Peters et al. | 165/110 X |

FOREIGN PATENT DOCUMENTS

| | | | |
|---|---|---|---|
| 1,175,653 | 3/1959 | France | 165/158 |

*Primary Examiner*—Alan Cohan
*Assistant Examiner*—Gerald A. Michalsky
*Attorney, Agent, or Firm*—Herbert L. Lerner

[57] ABSTRACT

Feedwater preheater for heating feedwater in the form of steam turbine condensate by means of condensing extraction steam from a turbine, includes a casing, a fixed tube plate and a movable tube plate disposed opposite one another in the casing, feedwater inlet and outlet chambers located adjacent the fixed tube plate, a feedwater reversing chamber disposed in the casing and partly defined by the movable tube plate, a first group of feedwater conducting tubes connected at one end thereof through the fixed tube plate to the feedwater inlet chamber and at the other end through the movable tube plate to the reversing chamber, a second group of tubes connected at one end thereof through the movable tube plate to the reversing chamber and at the other end thereof through the fixed tube plate to the feedwater outlet chamber, a steam vessel disposed in the casing and surrounding the second group of tubes, the first group of tubes, on the one hand, and the second group of tubes, on the other hand, being mutually spaced apart a distance so great that stresses produced by varying thermal expansion of the tubes which, in turn, produce a tipping movement and deformation of the movable tube plate do not exceed a permissible value.

4 Claims, 4 Drawing Figures

FEEDWATER PREHEATER WITH TWO STEAM CHAMBERS

The invention of the instant application relates to a feedwater preheater for two-stage heating of steam turbine condensate by means of condensing turbine bleeder steam. The feedwater preheater is horizontally disposed in the interior of the exhaust steam housing of a turbine. Such feedwater preheater has become known heretofore from German Pat. No. 1,626,210 wherein tubes bent into hair-pin shape are secured in a tube plate so that each tube and each tube system can perform the expansion movements that are necessary to avoid thermal stresses. The preheater is thus traversed in four channels by the feedwater.

It has become apparent that, in turbosets of high capacity, especially for light water-nuclear power plants, the space available in vertical direction is insufficient for receiving therein a preheater with four feedwater channels. An increase in the size of the structure is very costly, and a decrease in the diameter of the feedwater-preheater with four flow-through channels results in excessive feedwater velocities.

Feedwater preheaters with tubes that are not hair-pin shaped have also become known heretofore. Such a preheater is described, for example, in the book "Grosse Dampfkraftwerke" (Large Steam Power Plants) by K. Schroeder, Volume III, Section A, Page 326, FIG. 307, Springer-Verlag 1966 of Germany. In this type of preheater construction, straight or rectilinear tubes are secured in two tube plates, one of the tube plates being rigidly connected to the steam jacket while the other tube plate is movably constructed as a floating head.

It is an object of the invention to provide a feedwater preheater having two steam chambers which can use steam at two different pressures for heating the feedwater and which can be installed in the exhaust steam connecting piece of a turbine without increasing the over-all height or headroom.

With the foregoing and other objects in view, there is provided, in accordance with the invention, feedwater preheater for heating feedwater in the form of steam turbine condensate by means of condensing extraction steam from a turbine, comprising a casing, a fixed tube plate and a movable plate disposed opposite one another in the casing, feedwater inlet outlet chambers located adjacent the fixed tube plate, a feedwater reversing chamber disposed in the casing and partly defined by the movable tube plate, a first group of feedwater conducting tubes connected at one end thereof through the fixed tube plate to the feedwater inlet chamber and at the other end through the movable tube plate to the reversing chamber, a second group of tubes connected at one end thereof through the movable tube plate to the reversing chamber and at the other end thereof through the fixed tube plate to the feedwater outlet chamber, a steam vessel disposed in the casing and surrounding the second group of tubes, the first group of tubes, on the one hand, and the second group of tubes, on the other hand, being mutually spaced apart a distance so great that stresses produced by varying thermal expansion of the tubes which, in turn, produce a tipping movement and deformation of the movable tube plate do not exceed a permissible value.

In accordance with another feature of the invention the first group of tubes outside the steam chamber and the second group of tubes inside the steam chamber are separated by a free space for distributing turbine extraction steam therein.

In accordance with a further feature of the invention, there is provided a feedwater preheater in combination with a steam turbine, the casing of the preheater being firmly connected to two opposing walls of a connecting piece extending from the turbine. The connection between the preheater and the walls of the turbine connecting piece may be effected, for example, by welding. Structures for bracing or reinforcing the walls of the preheater against outside pressure can thereby be dispensed with.

Other features which are considered as characteristic for the invention are set forth in the appended claims.

Although the invention is illustrated and described herein as feedwater preheater with two steam chambers, it is nevertheless not intended to be limited to the details shown, since various modifications and structural changes may be made therein without departing from the spirit of the invention and within the scope and range of equivalents of the claims.

The construction and method of the invention, however, together with additional objects and advantages thereof will be best understood from he following description of specific embodiments when read in connection with the accompanying drawing, in which.

Figure 1:
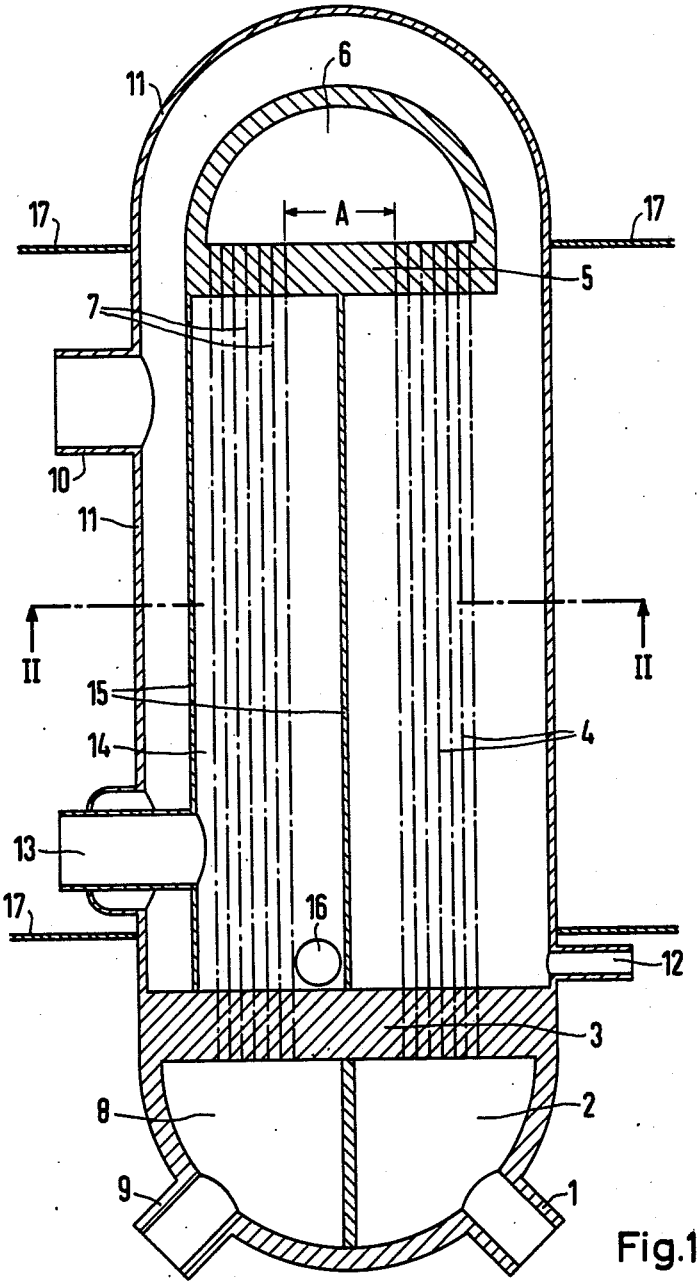
FIG. 1 is a diagrammatic longitudinal sectional view of a feedwater preheater constructed in accordance with the invention.
Figure 2:
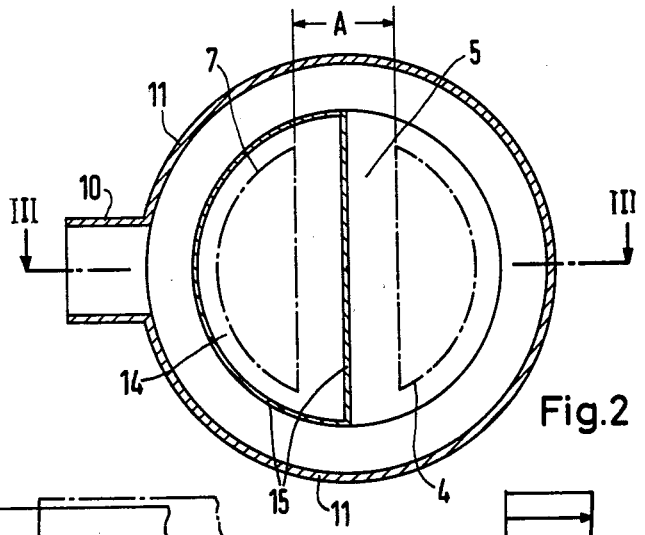
FIG. 2 is a cross-sectional view of FIG. 1 taken along the line II — II in the direction of the arrows.

Referring now to the drawing and first, particularly, to FIGS. 1 and 2 thereof, there is shown a feedwater preheater constructed in accordance with the invention, respectively, in longitudinal and cross-sectional views thereof. Feedwater is admitted through a connecting piece or union 1 into an inlet chamber 2 for the feedwater which is defined in part by a tube plate 3. Heat exchanging tubes 4 are secured at one end thereof in the tube plate 3. The other end of the heat exchanging tubes 4 are secured, in turn, in a movable tube plate 5 partly defining a reversing chamber 6. Additional heat exchanging tubes 7 are connected at one end thereof to another part of the movable tube plate 5 than the part at which the tubes 4 are connected thereto. The additional heat exchanging tubes 7 are connected at the other end thereof to a part of the stationary tube plate 3 which partially defines an outlet chamber 8 for the feed water.

The feedwater flows successively through the tubes 4 and the tubes 7 wherein it is heated. It then leaves the preheater through the connecting piece 9 after passing through the outlet chamber 8.

Superheated steam from a lower extraction or bleeder stage of the turbine enters through a connecting piece 10 into the outer steam chamber of the preheater, which is defined by the preheater casing 11 and condenstes on the tubes 4. The condensate leaves the outer steam chamber through a connecting piece 12 extending from the preheater casing 11.

Superheated steam for the next higher extraction or bleeder stage of the turbine enters through a connecting piece 13 into an inner steam chamber 14 which is defined by sheets or plates 15 and parts of the tube plates 3 and 5. The steam condensates on the tubes 7, and the condensate discharged from the inner steam chamber 14 through a connecting piece 16. The preheater casing wall 11 is connected to walls 17 of the exhaust steam connecting piece of an otherwise non-illustrated steam turbine.

Due to the heating of the feedwater, great expansions occur in the tubes 7 as well as in the tubes 4. Furthermore, the operating pressure of the feedwater effects a deformation in the tube plates 3 and 5. In order to keep the stresses in the material, of which the plates 3 and 5 are formed, from exceeding permissible limit values, the tubes 7 mostly adjacent one another inside the inner steam chamber 14 are collectively spaced apart a distance A from the group of mutually adjacent tubes 4 located outside the inner steam chamber 4 and inside the outer steam chamber defined by the preheater casing 11.

One might conclude from an examination of the cross-sectional view of the feedwater preheater according to FIG. 2 that, because of the spacing A between the fields of tubes 4 and 7, no overall height or headroom can be saved or reduced in vertical direction. This is not true, however, because the space requirement for the introduction and distribution of the bleeder or extraction steam, when taking into account permissible flow velocities, is greater than the space requirement for the tubes 4 and 7 conducting the feedwater. The space provided by the spacing A is used for steam distribution.

Figure 3:
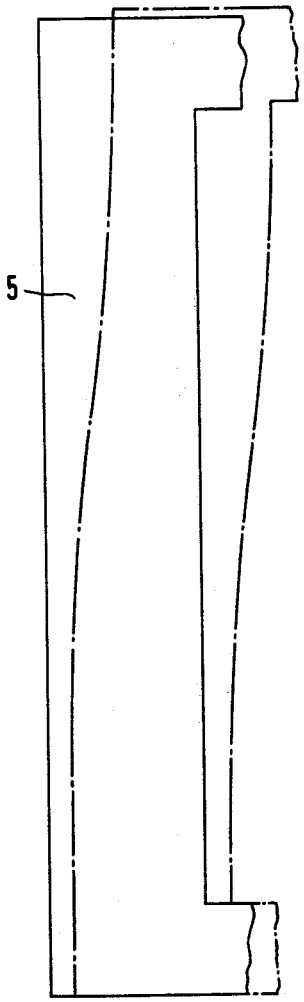
FIG. 3 is an enlarged diagrammatic view of the tube plate shown in the upper part of FIG. 1 in normal and deformed states thereof.
Figure 4:
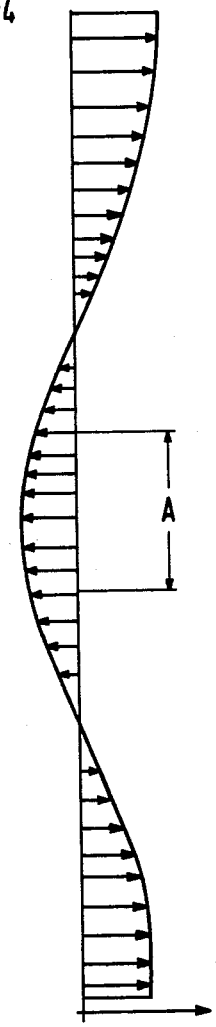
FIG. 4 is a stress diagram with respect to the upper tube plate deformation shown in FIG. 3.

The deformations and stresses occurring during a practical application of the embodiment of the invention illustrated in FIGS. 1 and 2 are shown, respectively, in FIGS. 3 and 4.

FIG. 3 shows in phantom the deformation under the effects of the operating temperatures and operating pressures occurring in the movable tube plate 5 (in solid lines) at the plane thereof represented by the section line III — III in FIG. 2.

In FIG. 4, the respective maximal stresses are shown in comparison with the permissible stress of the material of which the tube plate 5 is formed.

There is claimed:

1. Feedwater preheater for heating feedwater in the form of steam turbine condensate by means of condensing extraction steam from a turbine, comprising a casing containing an outer steam chamber, a fixed tube plate and a movable tube plate disposed opposite one another in the casing, feedwater inlet and outlet chambers located adjacent said fixed tube plate, a feedwater reversing chamber disposed in said casing and partly defined by said movable tube plate, a first group of rectilinear feedwater conducting tubes connected at one end thereof through said fixed tube plate to said feedwater inlet chamber and at the other end through a first part of said movable tube plate to said reversing chamber, a second group of rectilinear tubes connected at one end thereof through a second part of said movable tube plate to said reversing chamber and at the other end thereof through said fixed tube plate to said feedwater outlet chamber, a steam vessel disposed in said casing and surrounding said second group of tubes, said steam vessel being closed against communication with said outer steam chamber and being rigidly connected to said second part, said first part of said movable tube plate extending freely beyond the connection of said steam vessel to said second part of said movable tube plate, said first group of tubes, on the one hand, and said second group of tubes, on the other hand, being substantially parallel to and coextensive with one another being mutually spaced apart a given distance so as to permit tipping and deformation of said movable tube plate within given limits in response to stresses producible therein by varying thermal expansion of the tubes of said first and second groups thereof.

2. Feedwater preheater according to claim 1 wherein said first group of tubes outside said steam vessel and said second group of tubes inside said steam vessel are separated by a free space for distributing turbine extraction steam therein.

3. Feedwater preheater according to claim 1 in combination with a steam turbine, and wherein said casing is firmly connected to two opposing walls of a connecting piece extending from the turbine.

4. Feedwater preheater according to claim 1 including means for supplying steam at different temperature and pressure to said steam vessel and to said outer steam chamber, and means for exhausting the steam in said steam vessel and in said outer steam chamber independently of one another.

* * * * *